United States Patent [19]

Lowe

[11] 4,161,451

[45] * Jul. 17, 1979

[54] LUBRICATING OIL ADDITIVE COMPOSITION

[75] Inventor: Warren Lowe, El Cerrito, Calif.

[73] Assignee: Chevron Research Company, San Francisco, Calif.

[ * ] Notice: The portion of the term of this patent subsequent to Jul. 25, 1995, has been disclaimed.

[21] Appl. No.: 890,879

[22] Filed: Mar. 27, 1978

Related U.S. Application Data

[63] Continuation-in-part of Ser. No. 672,805.

[51] Int. Cl.[2] ..... C10M 1/48; C10M 3/42; C10M 5/24; C10M 7/46

[52] U.S. Cl. ..... 252/32.7 E; 252/47; 252/47.5; 252/50; 252/400 A; 252/401

[58] Field of Search ..... 252/32.7 E, 47, 47.5, 252/50, 402, 400 A, 401

[56] References Cited

U.S. PATENT DOCUMENTS

| | | | |
|---|---|---|---|
| 2,305,034 | 12/1942 | Rosen et al. | 252/402 |
| 2,718,501 | 9/1955 | Harle | 252/47 |
| 2,958,663 | 11/1960 | Westcott et al. | 252/47.5 |
| 3,004,916 | 10/1961 | Ertelt | 252/32.7 E |
| 3,345,292 | 10/1967 | Neale et al. | 252/47 |
| 3,398,095 | 8/1968 | Judd | 252/47.5 |
| 3,839,210 | 10/1974 | Beiswanger et al. | 252/47.5 |

*Primary Examiner*—Delbert E. Gantz
*Assistant Examiner*—Irving Vaughn
*Attorney, Agent, or Firm*—D. A. Newell; J. J. DeYoung

[57] ABSTRACT

A lubricating oil additive composition which imparts improved oxidation properties to crankcase lubricants comprises a antioxidant selected from aromatic and alkyl sulfides and polysulfides, sulfurized olefins, sulfurized carboxylic acid esters and sulfurized ester-olefins, and a secondary amine of the formula:

$$R-\overset{H}{N}-R'$$

wherein R and R' are aliphatic radicals. Lubricating oil compositions containing this additive composition are also disclosed.

14 Claims, No Drawings

LUBRICATING OIL ADDITIVE COMPOSITION

CROSS-REFERENCE TO RELATED APPLICATION

This application is a continuation-in-part of copending application Ser. No. 672,805, filed Apr. 4, 1976 now U.S. Pat. No. 4,102,796, the entire disclosure of which is incorporated herein by reference.

BACKGROUND OF THE INVENTION

This invention relates to an improved lubricating composition, and more particularly, this invention relates to a lubricating composition containing an additive combination having improved antioxidation properties.

Hydrocarbon oils are partially oxidized when contacted with oxygen at elevated temperatures for long periods. The internal combustion engine is a model oxidator, since it contacts a hydrocarbon motor oil with air under agitation at high temperatures. Also, many of the metals (iron, copper, lead, nickel, etc.) used in the manufacture of the engine and in contact with both the oil and air, are effective oxidation catalysts which increase the rate of oxidation. The oxidation in motor oils is particularly acute in the modern internal combustion engine which is designed to operate under heavy work loads and at elevated temperatures.

The oxidation process produces acidic bodies within the motor oil which are corrosive to typical copper, lead, and cadmium engine bearings. It has also been discovered that the oxidation products contribute to piston ring sticking, the formation of sludges within the motor oil and an overall breakdown of viscosity characteristics of the lubricant.

Several effective oxidation inhibitors have been developed and are used in almost all of the conventional motor oils today. Typical of these inhibitors are the sulfurized oil-soluble organic compounds, such as aromatic and alkyl sulfides and polysulfides, sulfurized olefins, sulfurized carboxylic acid esters and sulfurized ester-olefins, as well as zinc dithiophosphates and the oil-soluble phenolic and aromatic amine antioxidants. These inhibitors while exhibiting good antioxidant properties, are burdened by economic and oil contamination problems. It is preferred to maintain the sulfur content of the oil, as low as possible, while at the same time receiving the benefits of the antioxidation property. A need, therefore, exists for an improved antioxidant that is stable at elevated temperatures, that can be employed in reduced concentrations, and that is economical and easy to produce.

DESCRIPTION OF THE PRIOR ART

U.S. Pat. No. 2,718,501 discloses a synergistic mixture of a sulfur-containing compound, such as a wax sulfide or dioctadecyl disulfide, and an aromatic amine compound, such as phenyl alpha-naphthyl amine, for use in preventing oxidation in lubricating oils.

U.S. Pat. No. 2,958,663 discloses an extreme pressure lubricant composition containing from 0.01 to 5 percent each of sulfurized oleic acid, $C_{18}$–$C_{22}$ alkenyl succinic acid, chlorinated paraffin wax containing from 20 to 60 percent chlorine, diphenylamine and N,N-salicylal-1,2-propylenediamine.

U.S. Pat. No. 3,345,292 discloses stabilized alkyl substituted diaryl sulfides for use as functional fluids where the stabilizer can be diaryl amine or alkylated phenol.

U.S. Pat. No. 3,398,095 discloses the use of fatty acids and amines as being useful anticorrosives for ferrous metals.

U.S. Pat. No. 3,839,210 discloses an antioxidant composition comprising three components, a phenolic antioxidant, a sulfone and an amine.

It is an object of this invention to provide additive compositions for crankcase lubricating oils which impart improved antioxidant properties. It is a further object of this invention to provide a synergistic additive composition having antioxidant properties in crankcase lubricating oil compositions.

SUMMARY OF THE INVENTION

A lubricating oil additive composition which imparts improved oxidation properties to lubricants comprises an antioxidant selected from aromatic and alkyl sulfides and polysulfides, sulfurized olefins, sulfurized carboxylic acid esters and sulfurized ester-olefins, and an oil-soluble secondary amine of the formula:

$$R-\overset{H}{N}-R'$$

wherein R and R' are aliphatic radicals.

As a second embodiment, there is provided a lubricating oil composition comprising an oil of lubricating viscosity and an antioxidant amount of the composition described above comprising (1) an oil-soluble antioxidant selected from aromatic and alkyl sulfides and polysulfides, sulfurized olefins, sulfurized carboxylic acid esters and sulfurized ester-olefins, and (2) an oil-soluble secondary amine of the formula:

$$R-\overset{H}{N}-R'$$

wherein R and R' are aliphatic radicals.

It has been found that the antioxidant defined above in combination with the secondary amine as described above complement each other in a synergistic manner resulting in a combination having antioxidant properties superior to either additive alone. The secondary amine component has virtually no antioxidant effect. However, when the combination of secondary amine and antioxidant is added to a lubricating oil, less antioxidant is needed to control oxidation than when the secondary amine compound is not present.

Preferably, an oil-soluble zinc salt is present in the lubricating oil composition. While this zinc salt is not required to achieve the synergistic effect from the combination of the antioxidant and the secondary amine compound, a lubricating oil composition having improved performance characteristics results from the use of all three additive components.

DETAILED DESCRIPTION OF THE INVENTION

The compositions of this invention are highly stable additives for crankcase lubricating oils and impart excellent antioxidant properties to these oils.

The additive composition of this invention which imparts improved antioxidation properties to lubricants comprises (1) an oil-soluble antioxidant selected from aromatic and alkyl sulfides and polysulfides, sulfurized olefins, sulfurized carboxylic acid esters and sulfurized ester-olefins, and (2) a secondary amine of the formula:

$$R-\overset{H}{N}-R'$$

wherein R and R' are aliphatic radicals. The total number of carbon atoms in R and R' must be sufficient to render the compound oil soluble. Preferably R and R' each contain from 6 to 30 carbon atoms, and more preferably from 6 to 18 carbon atoms. In preferred compounds, R and R' are saturated, straight-chain hydrocarbon radicals.

The lubricant compositions of this invention contain a lubricating oil and the additive composition as described above. Preferably, the lubricating oil composition contains from 2 to 40 mmols of zinc per kilogram, which zinc is present as an oil-soluble zinc salt.

In a preferred embodiment of the lubricating oil composition, the antioxidant is present in the amount of from 0.25 to 10% weight and the secondary amine is present in the amount of 0.001 to 5% weight. The weight ratio of the antioxidant to the secondary amine is ordinarily in the range of 1 to 0.001-21.

More preferably, the antioxidant is present in the lubricating oil in the amount of 0.25 to about 2% weight. More preferably, the secondary amine compound is present in the amount of 0.01 to 0.3, preferably 0.05 to 0.3% weight.

In a further preferred embodiment, the oil-soluble zinc salt is present in an amount of from 9 to 30 mmols per kilogram.

ANTIOXIDANT COMPONENT

The class of antioxidants which may be employed in the practice of this invention are conventional ones including wax sulfides and polysulfides, sulfurized olefins, sulfurized carboxylic acid esters and sulfurized ester-olefins.

The sulfurized fatty acid esters are prepared by reacting sulfur, sulfur sulfur monochloride, and/or sulfur dichloride with an unsaturated fatty ester under elevated temperatures. Typical esters include $C_1$–$C_{20}$ alkyl esters of $C_8$–$C_{24}$ unsaturated fatty acids, such as palmitoleic, oleic, ricinoleic, petroselinic, vaccenic, linoleic, linolenic, oleostearic, licanic, paranaric, tariric, gadoleic, arachidonic, cetoleic, etc. Particularly good results have been obtained with mixed unsaturated fatty acid esters, such as are obtained from animal fats and vegetable oils, such as tall oil, linseed oil, olive oil, castor oil, peanut oil, rape oil, fish oil, sperm oil, and so forth.

Exemplary fatty esters include lauryl tallate, methyl oleate, ethyl oleate, lauryl oleate, cetyl oleate, cetyl linoleate, lauryl ricinoleate, oleyl linoleate, oleyl stearate, and alkyl glycerides.

Cross-sulfurized ester olefins, such as a sulfurized mixture of $C_{10}$–$C_{25}$ olefins with fatty acid esters of $C_{10}$–$C_{25}$ fatty acids and $C_1$–$C_{25}$ alkyl or alkenyl alcohols, wherein the fatty acid and/or the alcohol is unsaturated may also be employed in this invention.

Sulfurized olefins which may be employed as an antioxidant in the practice of this invention are prepared by the reaction of the $C_3$–$C_6$ olefin or a low-molecular-weight polyolefin derived therefrom with a sulfur-containing compound such as sulfur, sulfur monochloride, and/or sulfur dichloride.

Another class of organic sulfur-containing compounds which may be used in the practice of this invention is sulfurized aliphatic esters of an olefinic mono- or dicarboxylic acid, for example aliphatic alcohols of 1–30 carbon atoms, used to esterify monocarboxylic acids such as acrylic acid, methacrylic acid, 2,4-pentadienoic acid and the like, or fumaric acid, maleic acid, muconic acid, and the like. Sulfurization is carried out by combining the above-described esters with elemental sulfur, sulfur monochloride and/or sulfur dichloride.

The preferred antioxidants are the aromatic and alkyl sulfides, such as dibenzylsulfide, dixylyl sulfide, dicetyl sulfide, diparaffin wax sulfide and polysulfide, cracked wax-olefin sulfides and so forth. These antioxidants can be prepared by treating the starting material, e.g., olefinically unsaturated compounds, with sulfur, sulfur monochloride, and sulfur dichloride. Particularly preferred are the paraffin wax thiomers described in U.S. Pat. No. 2,346,156, the disclosure of which is hereby incorporated by reference.

All of the sulfides and polysulfides included within the scope of this invention are sulfurized sulfides and polysulfides. That is, the sulfide or polysulfide has been reacted with additional sulfur, sulfur chloride or sulfur dichloride after the initial formation of the sulfide. The sulfurization if any of the antioxidants may be carried out using sulfur, sulfur monochloride or sulfur dichloride. Residual chlorine that may be present in the antioxidant after sulfurization is not detrimental and may be beneficial.

THE SECONDARY AMINE COMPOUNDS

The second component of the additive composition for use in lubricating oils is a secondary amine compound of the formula:

$$R-\overset{H}{N}-R'$$

wherein R and R' are aliphatic radicals. The total number of carbon atoms in R and R' must be sufficient to render the compound oil soluble. Preferably R and R' each contain from 6 to 30 carbon atoms, and more preferably from 6 to 18 carbon atoms. In preferred compounds, R and R' are saturated, straight-chain hydrocarbon radicals.

The preparation of compounds within the scope of this invention is well known in the art. Typical compounds are di-n-decylamine, di-n-hexadecylamine, di-n-octadecylamine, and the like. Other typical compounds are those where the hydrocarbon portion of the compound is derived from mixtures of fatty acids. Preferred are those mixtures derived from coconut or soya bean oil. The amine derived from coconut oil (designated "dicocoamine") is particularly preferred. The coconut oil is hydrolyzed to yield a mixture of fatty acids which are further treated to yield an amine wherein the R and R' groups contain from 6 to 18 carbon atoms and are predominantly $C_{10}$, $C_{12}$ and $C_{14}$ radicals.

THE OIL-SOLUBLE ZINC SALT

The class of zinc salts which may be employed in the practice of this invention includes oil-soluble zinc salts which are used in the lubricating oil in amount to supply from 2 to 40 mmols of zinc per kilogram of oil.

The zinc salt is preferably a zinc dihydrocarbyldithiophosphate having from 4 to 20 carbon atoms in each hydrocarbyl group. The zinc dihydrocarbyldithiophosphate is formed by reacting the corresponding dihydrocarbyldithiophosphoric acid with a zinc base, such as zinc oxide, zinc hydroxide and zinc carbonate. The hydrocarbyl portions may be all aromatic, all aliphatic, or mixtures thereof.

Exemplary zinc dihydrocarbyldithiophosphates include:

zinc di(n-octyl)dithophosphate,
zinc butyl isooctyl dithiophosphate,
zinc di(4-methyl-2-pentyl)dithiophosphate,
zinc di(tetrapropenylphenyl)dithiophosphate,
zinc di(2-ethyl-1-hexyl)dithiophosphate,
zinc di(isooctyl)dithiophosphate,
zinc di(hexyl)dithiophosphate,
zinc di(ethylphenyl)dithiophosphate,
zinc di(amyl)dithiophosphate,
zinc butylphenyldithiophosphate, and
zinc di(octadecyl)dithiophosphate.

Preferred compounds are those zinc dihydrocarbyldithiophosphates having from 4 to 18 carbon atoms in each hydrocarbon group, and especially preferred are the zinc dialkyldithiophosphate wherein each alkyl group typically contains from 4 to 8 carbon atoms.

The lubricating oil composition is prepared by admixing, by conventional mixing techniques, the desired amount of antioxidant and secondary amine compound within a suitable lubricating oil. The selection of the particular base oil and secondary amine compound, as well as the amounts and ratios of each, depends upon the contemplated application of the lubricant and the presence of other additives. Generally, however, the amount of oil-soluble antioxidant employed in the lubricating oil will vary from 0.25 to 10, and usually from 0.25 to 2,% weight in most applications. The secondary amine compound will range from 0.01 to 2, and usually from 0.01 to 0.3, preferably from 0.05 to 0.3,% weight based on the weight of the final composition. The weight ratio of organic oil-soluble antioxidant to secondary amine will generally vary from 5-20 to 1, and usually from 10-20 to 1.

Concentrates of the additive compositions of this invention with a lubricating oil may be prepared for easier handling and for reduced storage costs as compared to the finished oil. The concentrates usually comprise from 10–90%, preferably 20–80%, of the additive composition admixed with lubricating oil. This concentrate is diluted with additional oil prior to use.

The lubricating oil which may be employed in the practice of this invention includes a wide variety of hydrocarbon oils such as naphthenic base, paraffin base, and mixed base oils. Other oils include lubricating oils derived from coal products and synthetic oils, e.g., alkylene polymers (such as propylene, butylene, and so forth, and mixtures thereof), alkylene oxide-type polymers (e.g. alkylene oxide polymers prepared by polymerizing alkylene oxides, such as ethylene oxide, propylene oxide, etc. in the presence of water or alcohol, e.g. ethyl alcohol), carboxylic acid esters (e.g. those which are prepared by esterifying carboxylic acids, such as adipic acid, azelaic acid, suberic acid, sebacic acid, alkenylsuccinic acid, fumaric acid, maleic acid and so forth, with an alcohol such as butyl alcohol, hexyl alcohol, 2-ethylhexyl alcohol, pentaerythritol and so forth, liquid esters of phosphorus-containing acids, such as trialkyl phosphate, tricresyl phosphate, etc., alkylbenzenes, polyphenyls (e.g. biphenyls and terphenyls), alkylbiphenyl ethers, esters and polymers of silicon, e.g. tetraethylsilicate, tetraisopropylsilicate, hexyl(4-methyl-2-pentoxy)disilicate, poly(methyl)siloxane, and poly(methylphenylsiloxane) and so forth. The lubricating oils may be used individually or in combinations whenever miscible, or whenever made so by use of mutual solvents. The lubricating oils generally have a viscosity which ranges from 50 to 5000 SUS (Saybolt Universal Seconds), and usually from 100 to 1500 SUS at 100° F.

In addition to the antioxidant, the amine compound and the oil-soluble zinc salt, other additives may be successfully employed within the lubricating composition of this invention without affecting its high stability and performance over a wide temperature scale. One type of additive which may be employed is a rust inhibitor. The rust inhibitor is employed in all types of lubricants to suppress the formation of rust on the surface of metallic parts. Exemplary rust inhibitors include sodium nitrite, alkenyl succinic acid and derivatives thereof, alkylthioacetic acid and derivatives thereof, polyglycols and derivatives thereof, alkoxylated amines and derivates thereof, and so forth. Another type of lubricating additive which may be employed in the compositions of this invention is ashless dispersants and detergents. Typical compositions included within this class are the conventional succinimides, succinates, hydrocarbylalkylene polyamines, alkaline earth metal salts of alkylaryl sulfonates, phenates and the like.

Other types of lubricating oil additives which may be employed in the practice of this invention include antifoam agents, (e.g. silicones, organic copolymers), stabilizers and antistain agents, tackiness agents, antichatter agents, dropping point improvers and antisquawk agents, lubricant color correctors, extreme pressure agents, odor control agents, detergents, antiwear agents, thickeners, and so forth.

LUBRICANT PERFORMANCE

The presence of the secondary amine within the lubricant composition promotes the antioxidation properties of the oil-soluble antioxidant used therewith. With this combination, less of the antioxidant is necessary in the lubricant formulation in order to achieve the desired antioxidation properties.

EXAMPLES

The following examples are presented to illustrate the practice of specific embodiments of this invention and should not be interpreted as limitations on the scope of this invention.

EXAMPLE 1

This example is presented to illustrate the effectiveness of the combination of the secondary amines with this antioxidant in improving the antioxidation properties of a lubricating oil over the use of either of the components individually. The oxidation test employed herein measures the resistance of the test sample to oxidation using pure oxygen with a Dornte-type oxygen absorption apparatus (R. W. Dornte, "Oxidation of White Oils", Industrial and Engineering Chemistry, Vol. 28, page 26, 1936). The conditions are an atmosphere of pure oxygen exposed to the test oil maintained at a temperature of 340° F. The time required for 100 g of test sample to absorb 1000 ml of oxygen is observed and reported in the following Tables I and II. The mid-continent test oil in Table I contains 6% of a conventional succinimide dispersant, 0.05% terephthalic acid, 0.4% of a conventional rust inhibitor and 9 mmols/kg of a zinc dihydrocarbyldithiophosphate. The test oil in Table II comprises a midcontinent neutral oil (50% Citcon 350 neutral+50% Citcon 650 neutral), and contains 6% of a conventional succinimide dispersant, 0.05% terephthalic acid, 0.4% of a conventional rust inhibitor and 9 mmols/kg of a zinc dihydrocarbyldithiophosphate.

TABLE I

| Antioxidant | Secondary Amine | Oxidation life hours |
|---|---|---|
| — | 0.1% dicocoamine | 0.48[1] |
| 1% diparaffin polysulfide | — | 6.1[2] |
| 1% diparaffin polysulfide | 0.1% dicocoamine | 8.9 |
| 1% diparaffin polysulfide | 0.1% dioctylamine | 8.6 |

[1]Base oil without zinc dithiophosphate
[2]Average of 3 tests

TABLE II

| Antioxidant | Secondary Amine | Oxidation Life Hours |
|---|---|---|
| — | — | 5.0 |
| 1% diparaffin polysulfide | — | 7.6[1] |
| — | 0.1% disoyamine | 5.05 |
| 1% diparaffin polysulfide | " | 7.9 |
| — | 0.2% di-n-hexylamine | 5.25 |
| 1% diparaffin polysulfide | " | 8.6 |
| — | 0.1% di(ethylhexyl)amine | 5.0 |
| 1% diparaffin polysulfide | " | 8.7 |

[1]Average of three tests.

EXAMPLE 2

The resistance to increase in viscosity of lubricating oils containing an antioxidant composition of this invention as compared to antioxidant alone is illustrated by the following engine test. In this test, an Oldsmobile engine is charged with 10.65 pounds of the oil to be tested. The engine is then started and run for 2 minutes at 850 rpm with no load. The rpm's are then increased to 1500 with a 50-pound load and 450 psi oil pressure, and the engine is run for 8 minutes. The engine is shut down with the oil circulating for 10 minutes. The oil pump is then shut down and the oil sampled after 5 minutes. This procedure is repeated until the viscosity of the oil increases 500%. The number of hours elapsed during the test is recorded.

The base oil used in this test is a midcontinent neutral oil having a viscosity of 350 SUS at 100° F., 6%wt of a conventional succinimide dispersant, 0.05% wt of terephthalic acid, and 0.4% wt of a conventional rust inhibitor. The results of this test are reported in Table III.

TABLE III

| Antioxidant | Secondary amine | Hrs. to reach 500% Visc. 100° F. |
|---|---|---|
| — | — | 28 |
| 2% diparaffin polysulfide | — | 52 |
| 1% diparaffin polysulfide | 0.1% dicocoamine | 232% vis. increase after 142 hrs.[1] |

[1]Engine test was terminated because of electronic problems.

The test procedure of Example 2 was repeated in a formulation containing 6% of a conventional succinimide dispersant, 40 mmols per kg of a calcium phenate and 18 mmols per kg of a zinc dithiophosphate. The results are shown in Table IV.

TABLE IV

| Antioxidant | Secondary Amine | Hours to 500% Visc. Increase |
|---|---|---|
| — | — | 44.56 |
| 2% diparaffin polysulfide | — | 92 |
| diparaffin polysulfide | 0.2% dicocoamine | 123 |
| 2% sulfurized cracked wax olefin (13% S) | " | 72 |
| 2% sulfurized cracked wax olefin (24% S) | " | >166[1] |

[1]The symbol > means "greater than".

What is claimed is:

1. An additive composition for use in crankcase lubricating oils comprising:
   (1) an oil-soluble antioxidant selected from aromatic and alkyl sulfides and polysulfides, sulfurized olefins, sulfurized carboxylic acid esters, and sulfurized ester-olefins, and
   (2) an oil-soluble secondary amine of the formula:

$$R-\overset{H}{N}-R'$$

wherein R and R' are aliphatic radicals.

2. The composition of claim 1 wherein the weight ratio of the antioxidant to the secondary amine is 1:0.001-21, and R and R' each contain from 6 to 30 carbon atoms.

3. A lubricating oil composition comprising a major amount an oil of lubricating viscosity and an antioxidant amount of the composition of claim 1.

4. A lubricating oil composition comprising a major amount an oil of lubricating viscosity and an antioxidant amount of the composition of claim 2.

5. The composition of claim 4 comprising an oil of lubricating viscosity, from 0.25 to 10% weight of said antioxidant, and from 0.001 to 5% weight of said secondary amine.

6. The composition of claim 5 which contains an antioxidant-antiwear amount of an oil-soluble zinc dihydrocarbyldithiophosphate salt, and wherein the antioxidant is a wax sulfide or polysulfide.

7. The composition of claim 6 which contains from 2 to 40 mmols of zinc per kilogram of composition, present as the oil-soluble zinc salt, from 0.25 to 2% weight of a paraffin wax thiomer antioxidant, and from 0.01 to 0.3% weight of the secondary amine.

8. The composition of claim 5 wherein R and R' are each alkyl of 6 to 18 carbon atoms.

9. The composition of claim 7 wherein the secondary amine is dicocoamine and the zinc salt is zinc dihydrocarbyl dithiophosphate.

10. The composition of claim 9 wherein said zinc salt is a zinc dialkyldithiophosphate wherein each alkyl group contains from 4 to 8 carbon atoms.

11. The composition of claim 5 wherein the antioxidant is a sulfurized cracked wax olefin and the secondary amine is dicocoamine.

12. A lubricating oil additive concentrate which comprises from 90-10% weight of an oil of lubricating viscosity and from 10–90% weight of the composition of claim 1.

13. A method for preparing the lubricating oil composition of claim 3 which comprises admixing an oil of lubricating viscosity with (1) an oil-soluble antioxidant selected from aromatic and alkyl sulfides and polysulfides, sulfurized olefins, sulfurized carboxylic acid esters and sulfurized ester-olefins, and (2) an oil-soluble secondary amine of the formula $$R-\overset{H}{N}-R'$$

wherein R and R' are aliphatic radicals, wherein the weight ratio of the antioxidant to the secondary amine is 1:0.001-21.

14. A method for inhibiting the oxidation of a lubricating oil which comprises adding to said lubricating oil from 0.25 to 10% weight of (1) an oil-soluble antioxidant selected from aromatic and alkyl sulfides and polysulfides, sulfurized olefins, sulfurized carboxylic acid esters and sulfurized ester-olefins, and (2) from 0.001 to 5% weight of an oil-soluble secondary amine of the formula $$R-\overset{H}{N}-R'$$

wherein R and R' are aliphatic radicals.

* * * * *